US010053879B1

(12) United States Patent
Wagoner

(10) Patent No.: US 10,053,879 B1
(45) Date of Patent: Aug. 21, 2018

(54) METHOD FOR REMEDIATING WATER DAMAGE TO A MASONRY STRUCTURE

(71) Applicant: James Eric Wagoner, Sugarland, TX (US)

(72) Inventor: James Eric Wagoner, Sugarland, TX (US)

( * ) Notice: Subject to any disclaimer, the term of this patent is extended or adjusted under 35 U.S.C. 154(b) by 0 days.

(21) Appl. No.: 15/716,734

(22) Filed: Sep. 27, 2017

(51) Int. Cl.

| | |
|---|---|
| ***E04G 23/02*** | (2006.01) |
| ***E04G 23/00*** | (2006.01) |
| ***E04F 13/08*** | (2006.01) |
| ***E04B 1/41*** | (2006.01) |
| ***E04F 13/076*** | (2006.01) |
| *E04B 2/02* | (2006.01) |
| *E04F 13/075* | (2006.01) |

(52) U.S. Cl.
CPC ..... *E04G 23/0296* (2013.01); *E04B 1/4178* (2013.01); *E04F 13/076* (2013.01); *E04F 13/0898* (2013.01); *E04G 23/002* (2013.01); *E04B 2002/0286* (2013.01); *E04F 13/075* (2013.01)

(58) Field of Classification Search
CPC ... E04G 23/0296; E04G 23/06; E04G 23/002; E04G 23/0288; B23P 6/04
See application file for complete search history.

(56) References Cited

U.S. PATENT DOCUMENTS

| | | | | |
|---|---|---|---|---|
| 1,928,246 | A * | 9/1933 | Brinker | A47L 11/38 15/385 |
| 5,154,539 | A * | 10/1992 | McCown, Sr. | E02D 27/48 405/230 |
| 6,171,406 | B1 * | 1/2001 | Otsuki | B08B 6/00 134/22.1 |
| 6,807,786 | B1 * | 10/2004 | Peck | E04F 13/02 52/514.5 |
| 9,169,663 | B1 * | 10/2015 | Moss | E04G 23/02 |
| 2014/0272250 | A1 * | 9/2014 | Dirkson | E04C 2/04 428/63 |
| 2017/0051522 | A1 * | 2/2017 | Velazquez | G05B 19/402 |

* cited by examiner

*Primary Examiner* — Gisele D Ford
(74) *Attorney, Agent, or Firm* — Buskop Law Group, P.C.; Wendy Buskop

(57) ABSTRACT

A method of remediating a water-damaged masonry building without removing any masonry from the building, and simultaneously providing water proofing to the structure. The method involves installing a parging coat of a reliner to the pest control wire over cleaned weep holes in masonry and to a water damaged interior portions of an installed masonry exterior wall. The reliner is cured. The method involves caulking a sill plate with gasket to a foundation of the water damaged masonry building with a silicon sealant after installing the reliner. Next each wag panel is connected to the water damaged studs forming a continuous seamless structure in the remediated building that prevents water incursion into the building after remediation of at least 95% and without removing the masonry.

9 Claims, 7 Drawing Sheets

FIG. 3B

150
CHEMICALLY ETCHING SIMULTANEOUSLY THE MASONRY LEDGE AND THE FOUNDATION TO A PREDETERMINED WIDTH AND TO THE DRY HEIGHT FORMING AN ETCHED INNER SURFACE AND ETCHED FOUNDATION

160
INSTALLING PEST CONTROL WIRE OVER THE WEEP HOLES

173
USING A FAN WITH A FILTER TO REMOVE PARTICULATE FROM AIR IN THE WATER DAMAGED BUILDING PRIOR TO INSTALLING THE PARGING COAT OF A RELINER

174
WASHING CONTAMINATES OFF EACH MASONRY OF A FOUNDATION OF THE WATER DAMAGED MASONRY BUILDING WITH A WASHING ASSEMBLY PRIOR TO INSTALLING A PARGING COAT OF A RELINER WHILE THE MASONRY OF THE WATER DAMAGED MASONRY BUILDING REMAINS WET

175
DEHUMIDIFYING THE WATER DAMAGED MASONRY BUILDING WHILE DRYING WATER DAMAGED STUDS PRIOR TO INSTALLING THE PARGING COAT OF A RELINER

177
IDENTIFYING PRIORITY ZONES IN THE WATER DAMAGED BUILDING FOR REHABITATION PRIOR TO INSTALLING THE PARGING COAT OF A RELINER.

180
APPLYING A PARGING COAT OF RELINER TO THE RELINER

190
DISPOSING A CURING AGENT ON THE RELINER

200
TRAPING MOISTURE IN THE CURING AGENT USING A COVER CONFIGURED TO PREVENT OXIDATION OF THE RELINER AND ALLOW PROPER CURE OF THE RELINER TO PREVENT CRACKING FOR A PRESET PERIOD OF TIME FORMING A CURED RELINER

METHOD FOR REMEDIATING WATER DAMAGE TO A MASONRY STRUCTURE

CROSS-REFERENCE TO RELATED APPLICATIONS

The present application claims priority to U.S. Provisional Patent Application Ser. No. 62/401,098, filed on Sep. 28, 2016 for "Method for Remediating Water Damage to a Brick Structure." This reference is hereby incorporated in its entirety.

FIELD

The present embodiment generally relates to a method for remediating a water-damaged masonry building without removing any masonry from the building.

BACKGROUND

A need exists for prevent future water intrusion into a building structure as an alternative to removing the masonry of a structure without replacing the exterior wall board.

The present embodiments meet these needs.

BRIEF DESCRIPTION OF THE DRAWINGS

The detailed description will be better understood in conjunction with the accompanying drawings as follows:

FIGS. 3A-3C an exemplary method according to one or more embodiments.

Figure 1A:
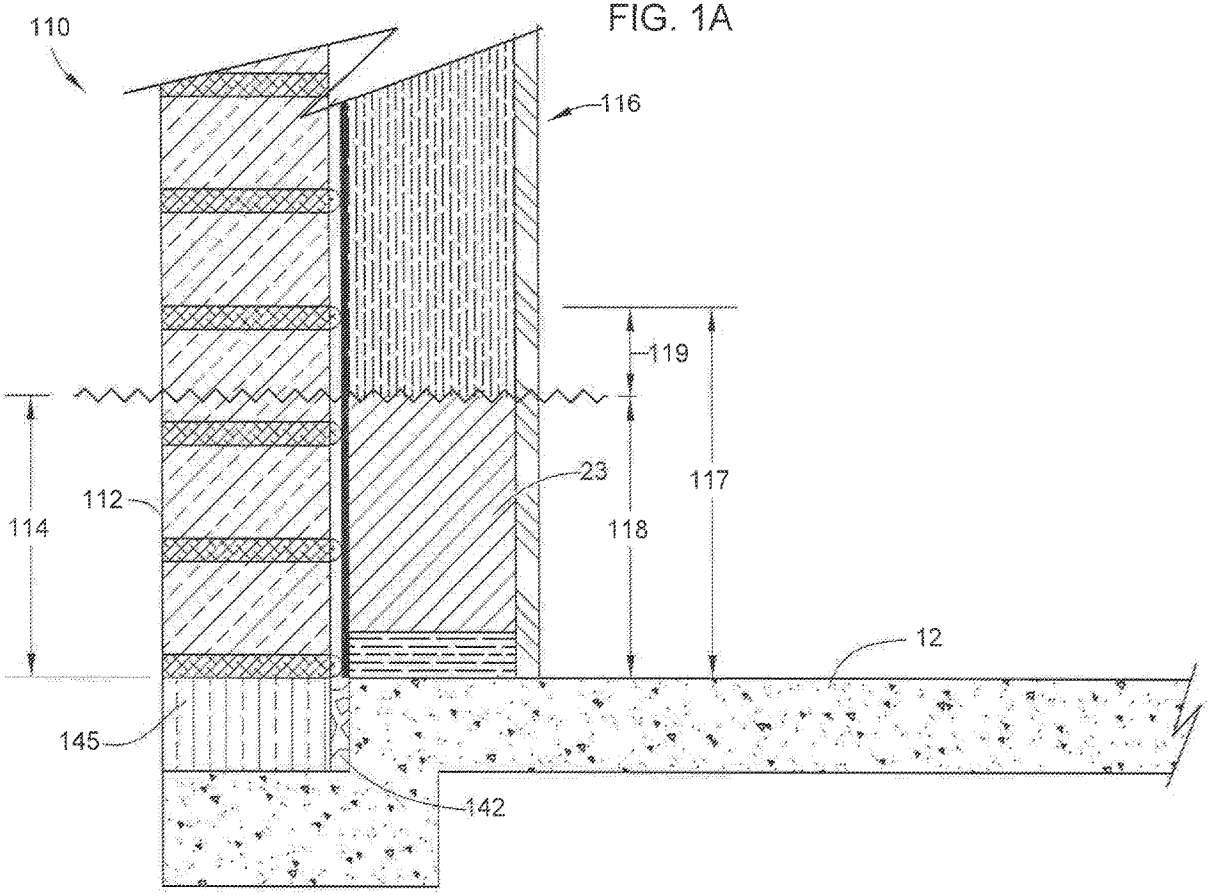
FIGS. 1A-1E depict a section view for a water-damaged masonry building according to one or more embodiments.
Figures 1B, 1C, 1D, 1E:
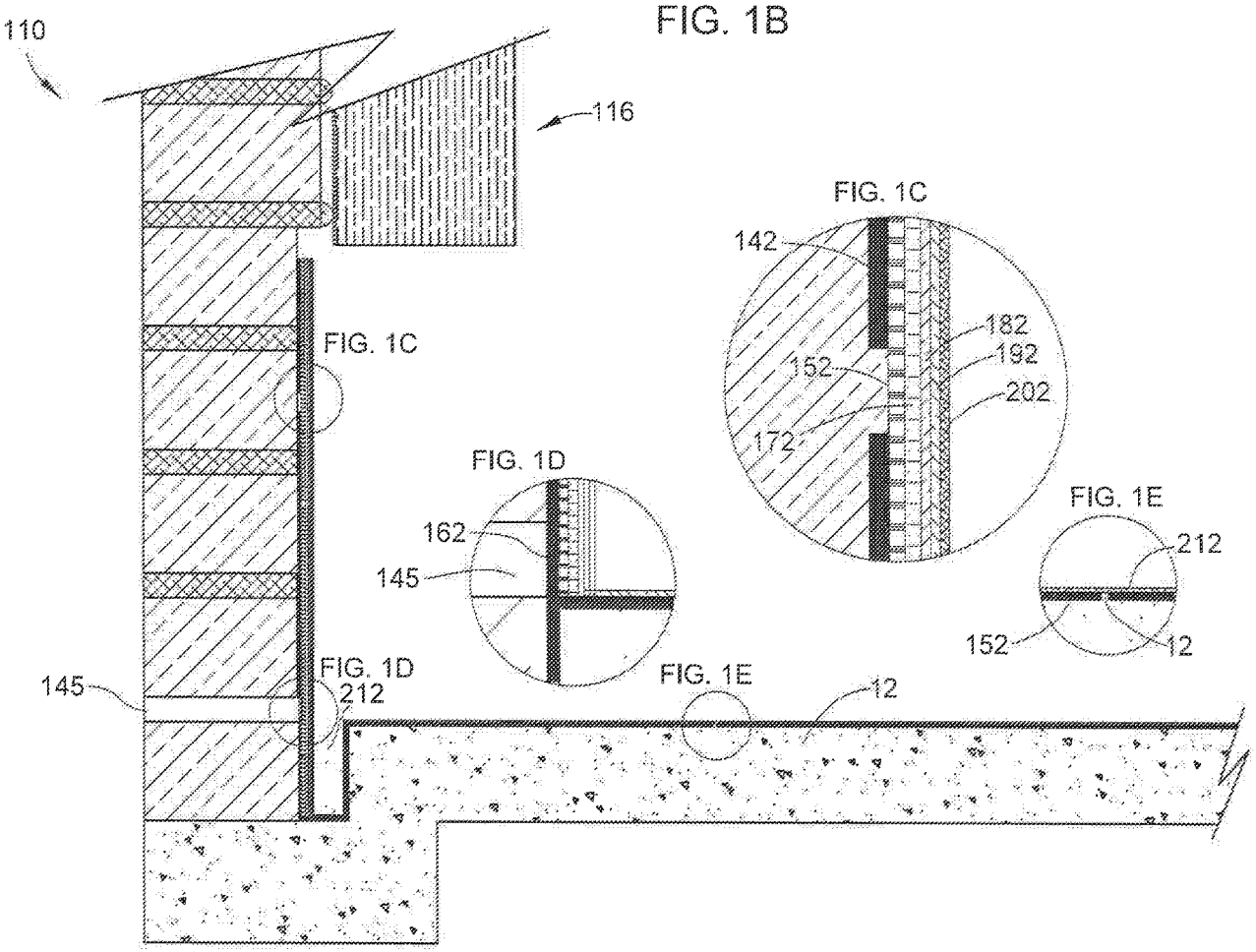

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The invention relates to a method of remediating a water-damaged masonry building without removing any masonry from the building, without removing masonry and with providing water proofing to the structure.

The invention provides an easier method to repair water damaged structure without removing the bricks.

The embodiments provide a water proof structure, which protects the structure from water damage, such as in the event of a natural disaster.

The invention creates a dry zone to prevent moisture from wicking through the concrete.

The invention protects the environment from the presence mold spores, which prevents individuals from having adverse health effects.

The invention adds structural strength to the bricks and the frame to protect from future damage.

The invention is for a remediated water-damaged masonry building having a foundation supporting a remediated outer wall and a remediated inner wall wherein zero masonry has been removed from the remediated water-damaged masonry building.

The method involves visually determining a dry height of a water damaged interior portions of an installed masonry exterior wall, the installed masonry exterior wall comprising studs and wallboard.

The method involves installing at least one beam on the water damaged interior portions of the installed masonry exterior wall to transfer load from the water damaged interior portions of the installed masonry exterior wall to the beam.

Next, construction materials are cut out of the water damaged interior portions of the installed masonry exterior wall from 1 foot above the dry height to the foundation.

The method involves clearing a masonry ledge and plurality of weep holes of the water damaged interior portions of the installed masonry exterior wall and an inner surface of the water damaged outer wall removing unwanted construction materials.

The next step of the method involves chemically etching simultaneously the masonry ledge and the foundation to a predetermined width and to the dry height forming an etched inner surface and etched foundation.

The method involves installing pest control wire over at least one weep hole.

A reliner is applied to the etched inner surface and over the pest control wire.

Next, a parging coat of reliner is applied to the reliner, then a curing agent is applied on the parging coat.

The method includes trapping moisture in the curing agent by using a cover that is configured to prevent oxidation of the reliner and allow proper cure of the reliner preventing cracking forming a cured reliner.

An isolation membrane is then painted on the curing agent and on the foundation.

A sill plate, a wag panel, house wrap, and studs are then used to rebuild water damaged interior portions of the installed masonry exterior wall, creating a dry area between wag panels and the isolation membrane. Each wag panel extends 0.5 inches to 1 inch below the sill plate eliminating growth of mold, fungus, and dampness in the interior portions of the installed masonry exterior wall.

The method includes caulking the sill plate with a silicon sealant that effectively connects the sill plate to the foundation.

Wag panels are then connected to the studs and the sill plate.

The beam is then removed.

Closed cell foam is installed over the wag panels forming a continuous seamless remediated inner wall that prevents at least 95% water incursion into the masonry building after remediation even though zero masonry has been removed from the masonry building.

Finally, sheet rock is installed over the closed cell foam.

The following terms are used herein:

The term "a masonry ledge" refers to the recessed area of the foundation, where the masonry is laid on the foundation.

The term "caulking" as used herein refers to applying a silicon sealant between two elements being repaired, namely a sill plate and a foundation, or gaps in other repaired elements of the building.

The term "chemical etching" refers to the chemical treatment, such as with muriatic acid, or a more concentrated hydrochloric acid to remove bacteria, fungus, form a roughened surface on the masonry, enabling the surface of the masonry to maximize bonding over and into more of the surface of the masonry material creating a maximum load bond.

The term "contaminates" refers to roach droppings, loose mortar, or other pest droppings.

The term "curing agent" is a liquid resin or liquid polymer that enables the parging coat of the reliner to cure to a solid coating preventing cracking.

The term "initial moisture level" refers to a moisture level taken using a moisture meter at a particular location in the house where rot or damage is viewed. High moisture readings are logged to track the moisture content.

The term "interior side" of the water damaged masonry building, is the view of masonry from inside of the structure, as oriented at the masonry.

The term "liquid isolation membrane" refers to a rubberized paintable membrane that waterproofs the inside surface of the relined masonry.

The term "parging of a reliner" refers to a spayed on or troweled coat of the reliner, that is applied in fluid form, then cures to add waterproofing and structural strength to a water damaged building. The term can also refer to the process of applying a fine coat of reliner to finish the surface of a masonry wall. Also, the cement mortar coat itself.

The term "reliner" refers to a chemical composition that can shape concrete which is a dry concrete mix such as a water, fine aggregate, coarse aggregate, hydraulic cement, and an aqueous slurry of condensed silica fume, wherein the water to hydraulic cement weight ratio is about 0.18 to 0.33, and the condensed silica fume to hydraulic cement weight ratio is about 0.10 to 0.25. The mix has a slump of ½ inch or less as measured by ASTM C-143, removing the casting form from the cast mix and permitting the cast mix to cure such as reliners taught in U.S. Pat. No. 5,250,113 which is incorporated herein in its totality by reference.

The term "rot" refers to comprised wood damage, through dry rot, or wet rot that reduces the structural integrity of the wood, posing a danger to the structure or things that would cause the building to fail a building code inspection, such as splits in the lumber.

The term "silicon sealant" refers to a liquid sealant that slowly self cures to provide a flexible rubberized adhesive to join, in a water proof matter, two different components of the water damaged masonry building.

The term "sill plate" refers to a stud positioned in a horizontal orientation of the ground to which the vertical studs are attached.

The term "unwanted construction" materials refers to excess mortar and debris in the space between the water damaged inner wall and the water damaged outer wall.

The term "visual inspection" refers to a camera inspection or human visual inspection of a structure.

The term "wag panel" refers to a section of wood sheathing panel that has house wrap layered on one side to meeting building code, the house wrap is applied on an outer surface. The wood sheathing is typically an exterior application of a building material like plywood. In embodiments, the wag panel house wrap is cut long and wrapped over the wood sheathing and pulled inside the house to create a "Z flashing". The Z flashing prevents further leaking of water into the building. The wag panels are adhered to studs initially with adhesive then screws. The screws or fasteners do not penetrate the exterior wood sheathing of the wag panel, ensuring a seamless non-penetrable barrier to water.

The term "water-damaged masonry building" refers to a building, such as a house, which has had structural water damage, from flooding, hurricane, etc. The damage can be to the wallboard, insulation, or other components of the structure of the house, including but not limited to studs.

The term "weep hole" refers to a hole in the bottom of the masonry that ventilates moisture and water to run out of the masonry and air into the structure to dry the masonry.

Now turning to the Figures, FIG. 1A depicts a water-damaged masonry building 110 with a foundation 12.

A dry height 118 of a water damaged interior portions 116 of an installed masonry exterior wall 114 is determined with a visual inspection.

Construction materials 23 of the water damaged interior portions 116 of the installed masonry exterior wall 114 are cut out at a height 117 from 1 foot above 119 the dry height 118 to the foundation.

In embodiments, the exterior wall comprises the studs 223*a* and 223*b* and wallboard 112.

The height to be cut out is determined by industry standard according to most flood plan management offices run by municipalities and other governments.

A weep hole 145 and masonry ledge 142 of the water damaged outer wall is shown.

FIGS. 1B-1E depict a water-damaged masonry building 110 with foundation 12 and interior portion 116 that has been repaired.

A weep hole 145, which has been cleared of debris is depicted.

The masonry ledge 142 and the foundation 12 are chemically etching simultaneously using muriatic acid to a predetermined width and to the dry height, such as one foot in width to form an etched inner surface 152 and etched foundation 12.

Pest control wire 162 is shown installed over the weep holes 145. The pest control wire can be made from a mesh material.

Reliner 172 is applied to the etched inner surface 152 and over the pest control wire 162. The reliner is a dry concrete mix such as water, fine aggregate, coarse aggregate, hydraulic cement, and an aqueous slurry of condensed silica fume.

A parging coat 182 is applied over the reliner 172.

A curing agent 192 is applied over the parging coat 182.

A cover 202, such as a plastic cover is applied over the curing agent 192.

In embodiments, an isolation membrane 212 is painted on the foundation 12.

Figure 2A:
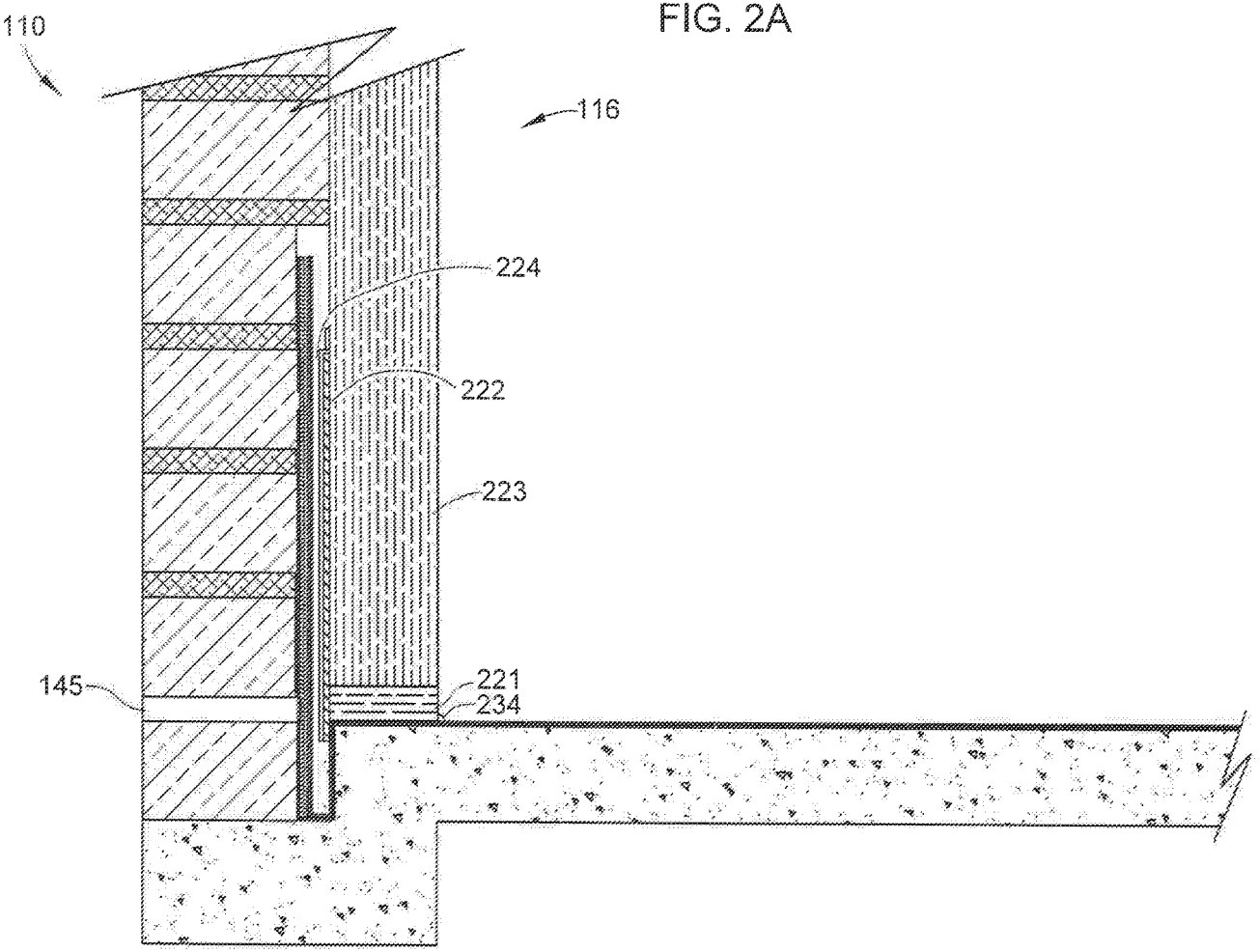
FIGS. 2A-2B depict details of the partially repaired inner wall according to one or more embodiments.

FIG. 2A depicts another embodiment of the water damaged interior portion 116 of the water-damaged masonry building 110.

A weep hole 145 of the water damaged outer wall is shown.

A sill plate 221, wag panel 222, house wrap, and studs 223 installing to rebuilding the inner wall creating a dry area between the wag panels and the isolation membrane, wherein the wag panel is installed below the sill plate, eliminating growth of mold, fungus, and dampness.

The sill plate is caulked with a silicon sealant 234 to connect the sill plate to the foundation creating a gasket.

Each wag panel 222 is connecting to the studs 223 and sill plate and at least one beam.

The sill plate 221, the wag panel 222, the house wrap, and the studs 223 are used to rebuild water damaged interior portions of the installed masonry exterior wall creating a dry area 224 between wag panels and the isolation membrane, wherein each wag panel extends ½ inch to 1 inch below the sill plate eliminating growth of mold, fungus, and dampness in the interior portions of the installed masonry exterior wall.

Figure 2B:
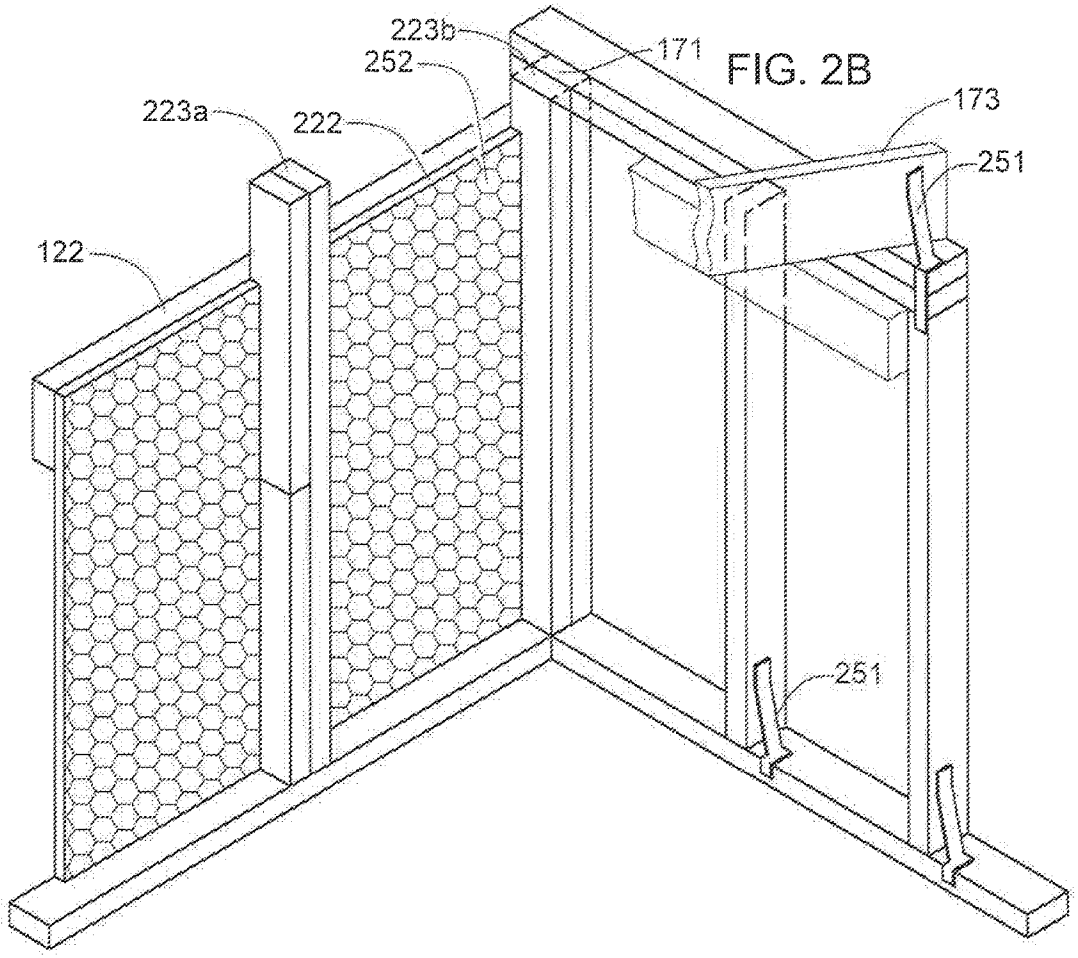

FIG. 2B depict a wag panel 222 is connecting to studs 223*a* and 223*b* and the sill plate.

Closed cell foam 252 is installed over the wag panels, forming a continuous seamless remediated inner wall that prevents at least 95% water incursion into the building after remediation even though zero masonry has been removed from the building.

Sheet rock is installed over the closed cell foam forming the remediated water-damaged masonry building.

In embodiments, a reinforcing member 251 can support the studs 223*a* and 223*b* and the wag panel 222.

At least one beam 122 is installed on the water damaged interior portions of the installed masonry exterior wall to transfer load from the water damaged interior portions of the installed masonry exterior wall 115 to the beam 122.

Figure 3A:
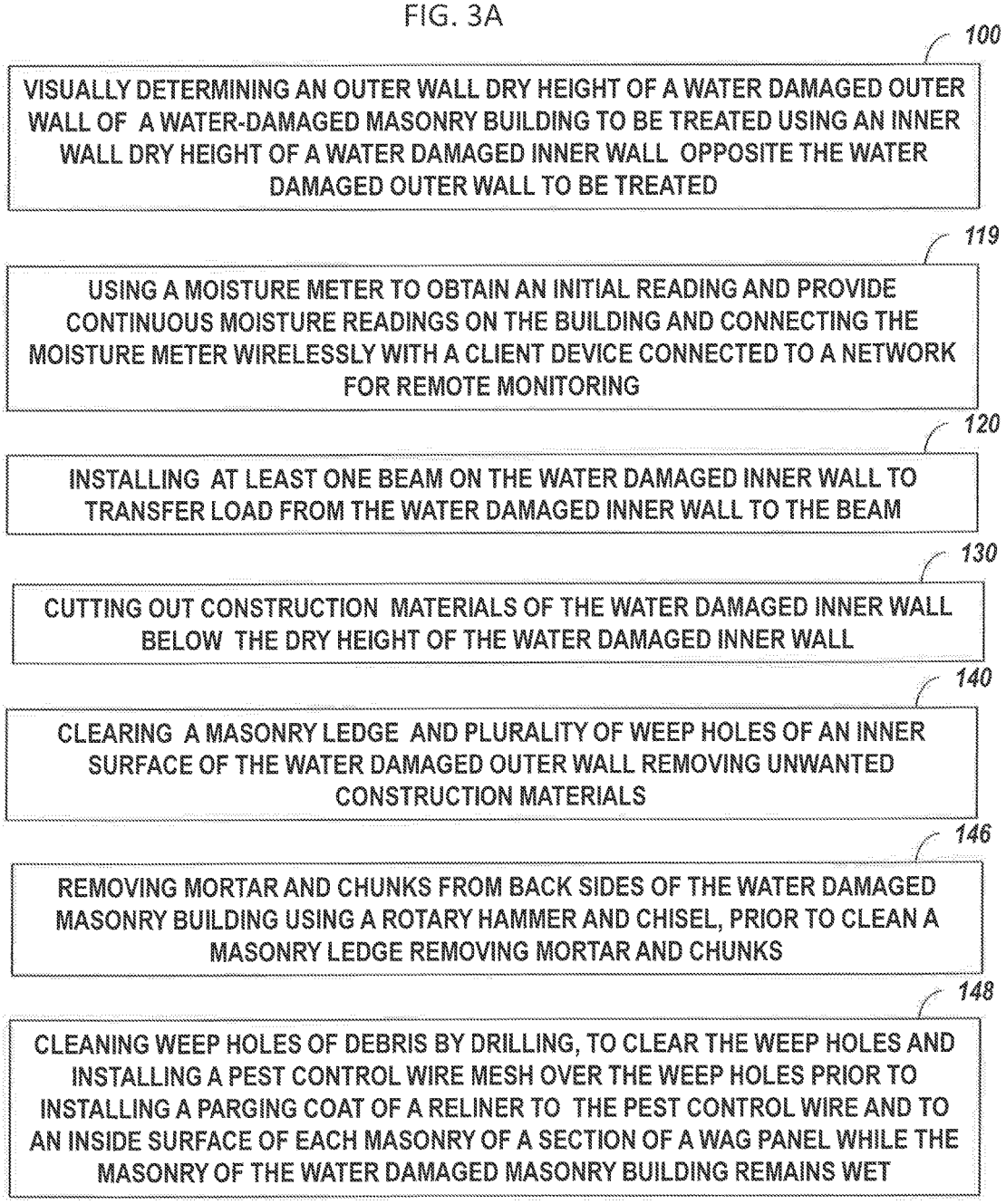
Figure 3C:
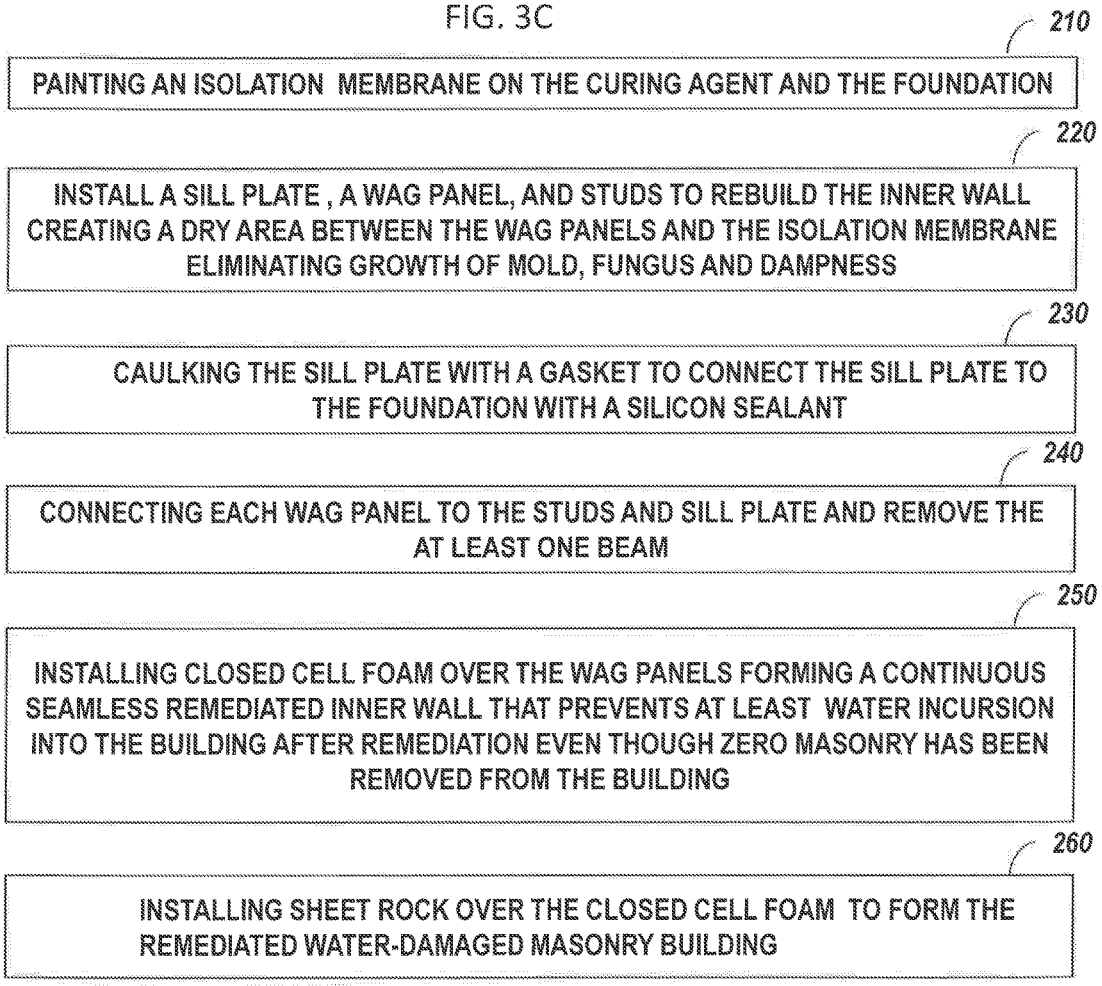

FIGS. 3A-3C depict an exemplary method according to one or more embodiments.

The method for remediated water-damaged masonry building, wherein zero masonry has been removed can include, but is not limited to the steps described below. The method can be utilized by a person of ordinary skill in the industry, and is not limited to a particular order or sequence.

Step 100 of the method involves visually determining a dry height of a water damaged interior portions of an installed masonry exterior wall, the installed masonry exterior wall comprising studs and wallboard.

Step 119 of the method involves using a moisture meter to obtain an initial reading and provide continuous moisture readings on the building and connecting the moisture meter wirelessly with a client device connected to a network for remote monitoring Step 120 of the method involves installing at least one beam on the water damaged interior portions of the installed masonry exterior wall to transfer load from the water damaged interior portions of the installed masonry exterior wall to the beam.

Step 130 of the method involves cutting out construction materials of the water damaged interior portions of the installed masonry exterior wall from 1 foot above the dry height to the foundation.

Step 140 of the method involves clearing a masonry ledge and plurality of weep holes of the water damaged interior portions of the installed masonry exterior wall an inner surface of the water damaged outer wall removing unwanted construction materials.

Step 150 of the method involves chemically etching simultaneously the masonry ledge and the foundation to a predetermined width and to the dry height forming an etched inner surface and etched foundation.

Step 160 of the method involves installing pest control wire over at least one weep hole.

Step 170 of the method involves applying reliner to the etched inner surface and over the pest control wire.

Step 173 can include using a fan with a filter to remove particulate from air in the water damaged building prior to installing the parging coat of a reliner.

Step 174 of the method involves washing chemically etching materials off the installed masonry exterior wall and foundation prior to installing a parging coat while the masonry remains wet.

Step 177 of the method involves identifying priority zones in the water damaged building for habitation prior to installing the parging coat of a reliner.

Step 180 of the method involves applying a parging coat 182 of reliner to the applied reliner.

Step 190 of the method involves applying a curing agent on the parging coat.

Step 200 of the method involves trapping moisture in the curing agent using a cover 202, configured to prevent oxidation of the reliner and allow proper cure of the reliner preventing cracking forming a cured reliner.

Step 210 of the method involves painting an isolation membrane on the curing agent and on the foundation.

Step 220 of the method involves installing a sill plate, a wag panel, house wrap, and studs to rebuild water damaged interior portions of the installed masonry exterior wall creating a dry area between wag panels and the isolation membrane, wherein each wag panel extends 0.5 inches to 1 inch below the sill plate eliminating growth of mold, fungus, and dampness in the interior portions of the installed masonry exterior wall.

Step 230 of the method involves caulking the sill plate with a silicon sealant connecting the sill plate to the foundation.

Step 238 of the method involves connecting wag panels to the studs and the sill plate.

Step 240 of the method involves removing the beam.

Step 250 of the method involves installing closed cell foam over the wag panels forming a continuous seamless remediated inner wall that prevents at least 95% water incursion into the masonry building after remediation even though zero masonry has been removed from the masonry building.

Step 255 of the method involves installing hurricane ties from a plurality of studs to the sill plate and from a plurality of studs to at least one of: a top plate and a roof rafter.

Step 260 of the method involves installing sheet rock over the closed cell foam.

In embodiments, the dry height can be one foot in width and one foot higher than the water line of a flood.

In embodiments, the parging coat can be applied at a thickness from ¼ inch to ½ inch.

In embodiments, the curing agent can be painted or sprayed on the reliner using a thickness that is less than ½ inch.

The method can include trapping moisture in the curing agent using a cover, such as a plastic cover.

The cover can be configured to prevent oxidation of the reliner and allow proper curing of the reliner to prevent cracking for a preset period of time, such as 24 hours, forming a cured reliner.

In embodiments, the wag panel house wrap is cut long and wrapped over the wood sheathing and pulled to the inner wall between the outer wall and stud and taped in place to create a "Z flashing" that prevents further leaking of water into the building.

In embodiments, the house wrap can be cut at least six inches long.

In embodiments, the masonry building can include structures from individual units, which are laid in and bound together by mortar.

The individual units can comprise a member of the group consisting of: brick, building stone, concrete block, glass block, and cob.

In embodiments, the building stone can be at least one of: marble, granite, travertine, and limestone.

In embodiments, the construction materials can include at least one member of the group consisting of: sill plate, sheet rock, studs, exterior wall board, wall framing materials, electrical components, and plumbing components.

Example 1

A remediated water-damaged masonry building 10 having a foundation 12 supporting a remediated outer wall and a remediated inner wall wherein zero masonry has been removed from the remediated water-damaged masonry building.

The outer wall dry height is visually determined for water damaged interior portions of an installed masonry exterior wall 115 of a water-damaged masonry building 110. An inner wall dry height for a water damaged inner wall that is opposite the water damaged outer wall is identified according to treated standards set by the Federal Emergency Management Administration (FEMA). In accordance with FEMA this height of the inner wall would be 1 foot above flood baseline.

At least one beam is installed on the water damaged inner wall to transfer load from the water damaged inner wall to the beam.

Construction materials are cut out of the water damaged inner wall below the dry height of the water damaged inner wall.

A masonry ledge 142 of an inner surface of the water damaged outer wall are cleared using a hammer to remove unwanted construction materials.

The masonry ledge and the foundation are chemically etching simultaneously using muriatic acid to a predetermined width and to the dry height, such as one foot in width to form an etched inner surface 152 and etched foundation 12.

Pest control wire 162 is installing over the weep holes 145 made from a mesh material.

Reliner 172 is applied to the etched inner surface 152 and over the pest control wire 162. The reliner is a dry concrete mix such as a water, fine aggregate, coarse aggregate, hydraulic cement, and an aqueous slurry of condensed silica fume.

A parging coat 182 of reliner is applied to the masonry at a thickness of ¼ inch.

A curing agent is painted on the reliner at a thickness of ¼ inch.

Moisture is trapped in the curing agent using a cover 202, such as a plastic cover. The cover is configured to prevent oxidation of the reliner and allow proper cure of the reliner to prevent cracking for a preset period of time, such as 24 hours, forming a cured reliner.

An isolation membrane 212 is painted on the curing agent and the foundation 12.

A sill plate 221, wag panel 222, house wrap, and studs 223 installing to rebuilding the inner wall creating a dry area 224 between the wag panels and the isolation membrane, wherein the wag panel is installed below the sill plate, eliminating growth of mold, fungus, and dampness.

The sill plate is caulked with a silicon sealant 234 to connect the sill plate to the foundation creating a gasket.

Each wag panel 222 is connecting to the studs 223 and sill plate and remove the at least one beam.

Closed cell foam 252 is installed over the wag panels, forming a continuous seamless remediated inner wall that prevents at least 95% water incursion into the building after remediation even though zero masonry has been removed from the building.

Sheet rock is installed over the closed cell foam forming the remediated water-damaged masonry building.

Example 2

A remediated water-damaged masonry building 10 having a foundation 12 supporting a remediated outer wall and a remediated inner wall wherein zero masonry has been removed from the remediated water-damaged masonry building.

The outer wall dry height is visually determined for a water damaged interior portions of an installed masonry exterior wall 115 of a water-damaged masonry building 110. An inner wall dry height is determined using the water damaged outer wall height and standards set by the local county's flood control agency. In accordance with the local county's flood control agency this height would be at least 1 foot above flood baseline.

At least one beam is installed on the water damaged inner wall to transfer load from the water damaged inner wall to the beam.

Construction materials are cut out of the water damaged inner wall below the dry height of the water damaged inner wall.

A masonry ledge 142 and plurality of weep holes 145 of an inner surface of the water damaged outer wall are cleared using a hammer to remove unwanted construction materials.

The masonry ledge and the foundation are chemically etching simultaneously using muriatic acid to a predetermined width and to the dry height, such as one foot in width to form an etched inner surface 152 and etched foundation 12.

Pest control wire 162 is installing over the weep holes 145 made from a galvanized steel mesh material.

Reliner 172 is applied to the etched inner surface 152 and over the pest control wire 162. The reliner is a dry concrete mix such as a water, fine aggregate, coarse aggregate, hydraulic cement, and an aqueous slurry of condensed silica fume.

A parging coat 182 of reliner is applied to the masonry at a thickness of ½ inch.

A curing agent is sprayed on the reliner at a thickness of ½ inch, such as polyurethane spray foam.

Moisture is trapped in the curing agent using a cover 202, such as a plastic cover. The cover is configured to prevent oxidation of the reliner and allow proper cure of the reliner to prevent cracking for a preset period of time, such as 36 hours, forming a cured reliner.

An isolation membrane 212 is painted on the curing agent and the foundation 12.

A sill plate 221, wag panel 222, house wrap, and studs 223 installing to rebuilding the inner wall creating a dry area 224 between the wag panels and the isolation membrane, wherein the wag panel is installed below the sill plate, eliminating growth of mold, fungus, and dampness.

The sill plate is caulked with a silicon sealant 234 to connect the sill plate to the foundation creating a gasket.

Each wag panel 222 is connecting to the studs 223 and sill plate and remove the at least one beam.

Closed cell foam 252 is installed over the wag panels, forming a continuous seamless remediated inner wall that prevents at least 95% water incursion into the building after remediation even though zero masonry has been removed from the building.

Sheet rock is installed over the closed cell foam forming the remediated water-damaged masonry building.

Example 3

A remediated water-damaged masonry building 10 having a foundation 12 supporting a remediated outer wall and a remediated inner wall wherein zero masonry has been removed from the remediated water-damaged masonry building.

The outer wall dry height is visually determined for a water damaged interior portions of an installed masonry exterior wall 115 of a water-damaged masonry building.

At least one beam is installed on the water damaged inner wall opposite the visually assessed outer wall to transfer load from the water damaged inner wall to the beam.

Construction materials are cut out of the water damaged inner wall below the dry height of the water damaged inner wall.

A masonry ledge 142 and plurality of weep holes 145 of an inner surface of the water damaged outer wall are cleared using a hammer to remove unwanted construction materials.

The masonry ledge and the foundation are chemically etching simultaneously using muratic acid to a predetermined width and to the dry height, such as one foot to form an etched inner surface 152 and etched foundation 12.

Pest control wire 162 is installing over the weep hole 145 made from a vinyl steel mesh material.

Reliner 172 is applied to the etched inner surface 152 and over the pest control wire 162. The reliner is a dry concrete mix such as a water, fine aggregate, coarse aggregate, hydraulic cement, and an aqueous slurry of condensed silica fume.

A parging coat 182 of reliner is applied to the masonry at a thickness of ⅜ inch.

A curing agent is painted on the reliner at a thickness of ⅜ inch.

Moisture is trapped in the curing agent using a cover 202, such as a plastic cover. The cover is configured to prevent oxidation of the reliner and allow proper cure of the reliner to prevent cracking for a preset period of time, such as 18 hours, forming a cured reliner.

An isolation membrane 212 is painted on the curing agent and the foundation 12.

A sill plate 221, wag panel 222, house wrap, and studs 223 installing to rebuilding the inner wall creating a dry area 224 between the wag panels and the isolation membrane, wherein the wag panel is installed below the sill plate, eliminating growth of mold, fungus, and dampness.

The sill plate is caulked with a silicon sealant 234 to connect the sill plate to the foundation creating a gasket.

Each wag panel 222 is connecting to the studs 223 and sill plate and remove the at least one beam.

Closed cell foam 252 is installed over the wag panels, forming a continuous seamless remediated inner wall that prevents at least 95% water incursion into the building after remediation even though zero masonry has been removed from the building.

Sheet rock is installed over the closed cell foam forming the remediated water-damaged masonry building.

In embodiments, the masonry building is made of structures from individual units, which are laid in and bound together by mortar.

In embodiments, the masonry ledge 142 and plurality of weep holes 145 of an inner surface of the water damaged outer wall can be cleared using a rotary hammer and chisel to remove mortar and the construction material from the backside of the water damaged outer wall.

In embodiments, the clearing of the masonry ledge and plurality of weep holes of an inner surface of the water damaged outer wall can be by cleaning weep holes of debris by drilling.

While these embodiments have been described with emphasis on the embodiments, it should be understood that within the scope of the appended claims, the embodiments might be practiced other than as specifically described herein.

What is claimed is:

1. A method of remediating a water-damaged masonry building having a foundation supporting an outer wall and an inner wall wherein zero masonry has been removed from the water-damaged masonry building, the method comprising:

a. visually determining a dry height of water damaged interior portions of an installed masonry exterior wall, the installed masonry exterior wall further comprising studs and wallboard;
b. installing at least one beam on the water damaged interior portions of the installed masonry exterior wall to transfer load from the water damaged interior portions of the installed masonry exterior wall to the beam;
c. cutting out construction materials of the water damaged interior portions of the installed masonry exterior wall from 1 foot above the dry height to the foundation;
d. clearing a masonry ledge and plurality of weep holes of the water damaged interior portions of the installed masonry exterior wall and an inner surface of a water damaged outer wall portion including removing unwanted construction materials;
e. chemically etching simultaneously the masonry ledge and the foundation to a predetermined width and to the dry height forming an etched inner surface and an etched foundation;
f. installing pest control wire over at least one of said weep holes;
g. applying reliner to the etched inner surface and over the pest control wire;
h. applying a parging coat of reliner to the applied reliner;
i. applying a curing agent on the parging coat;
j. trapping moisture in the curing agent using a cover, the cover configured to prevent oxidation of the parging coat and allow proper cure of the parging coat preventing cracking forming a cured parging coat;
k. painting an isolation membrane on the curing agent and on the foundation;
l. installing a sill plate, a wag panel, house wrap, and a plurality of studs to rebuild the water damaged interior portions of the installed masonry exterior wall thereby creating a dry area between the wag panel and the isolation membrane, wherein the wag panel extends 0.5 inches to 1 inch below the sill plate eliminating growth of mold, fungus, and dampness in the interior portions of the installed masonry exterior wall;
m. caulking the sill plate with a silicon sealant connecting the sill plate to the foundation; and
n. connecting the wag panel to the studs and the sill plate;
o. removing the beam;
p. installing closed cell foam over the wag panel forming a continuous seamless remediated inner wall that prevents at least 95% water incursion into the masonry a building after remediation; and
q. installing sheet rock over the closed cell foam.

2. The method of remediating a water-damaged masonry building of claim 1, wherein the masonry building comprises structures from individual units, which are laid in and bound together by mortar.

3. The method of remediating a water damaged masonry building of claim 2, wherein the individual units comprise: a member of the group consisting of: brick, building stone, concrete block, glass block, and cob.

4. The method of remediating a water damaged masonry building of claim 3, wherein the building stone is selected from the group consisting of: marble, granite, travertine, and limestone.

5. The method of remediating a water-damaged masonry building of claim 1, wherein the step of clearing the masonry ledge and the plurality of weep holes comprises using a rotary hammer and chisel to remove mortar and the construction material from the water damaged interior portions of the installed masonry exterior wall.

6. The method of remediating a water-damaged masonry building of claim 1, comprising washing chemically etching materials off the installed masonry exterior wall and foundation prior to installing a parging coat while the masonry remains wet.

7. The method of remediating a water-damaged masonry building of claim 1, wherein the clearing a masonry ledge and plurality of weep holes comprises cleaning by drilling.

8. The method of remediating a water-damaged masonry building of claim 1, comprising installing hurricane ties from the plurality of studs to the sill plate and from the plurality of studs to at least one of: a top plate and a roof rafter.

9. The method of remediating a water-damaged masonry building of claim 1, wherein the construction a materials include at least one member of the group consisting of: electrical components and plumbing components.

* * * * *